US009820591B2

(12) United States Patent
Popkin

(10) Patent No.: US 9,820,591 B2
(45) Date of Patent: Nov. 21, 2017

(54) PICTURE HANGER SYSTEM

(71) Applicant: Jeffrey Popkin, Weston, FL (US)

(72) Inventor: Jeffrey Popkin, Weston, FL (US)

( * ) Notice: Subject to any disclaimer, the term of this patent is extended or adjusted under 35 U.S.C. 154(b) by 0 days.

(21) Appl. No.: 15/056,282

(22) Filed: Feb. 29, 2016

(65) Prior Publication Data

US 2016/0249751 A1 Sep. 1, 2016

Related U.S. Application Data

(60) Provisional application No. 62/121,626, filed on Feb. 27, 2015.

(51) Int. Cl.
*A47G 1/16* (2006.01)

(52) U.S. Cl.
CPC ..... *A47G 1/1666* (2013.01)

(58) Field of Classification Search
CPC ..... A47G 1/20; A47G 1/16; A47G 1/1606; A47G 1/1613; A47G 1/1666
USPC .... 248/475.1, 476, 489, 493, 495, 327, 328, 248/690, 692, 302, 303, 304, 307, 306, 248/339
See application file for complete search history.

(56) References Cited

U.S. PATENT DOCUMENTS 358,069 A * 2/1887 Pratt ..... F16G 11/00 24/135 N
407,592 A * 7/1889 Harkness ..... E06B 9/324 160/178.2
549,505 A * 11/1895 Eldridge ..... A47G 1/16 248/489
550,456 A * 11/1895 Nealy ..... F16G 11/14 24/115 H
1,147,863 A * 7/1915 Hickerson et al. ..... A47G 1/16 248/489
1,455,961 A 6/1922 Maier
2,296,082 A * 9/1942 Bierk ..... F16G 11/00 24/130
3,049,323 A * 8/1962 Peterka ..... A47G 1/215 248/201

(Continued)

FOREIGN PATENT DOCUMENTS

WO WO2006091176 8/2006

*Primary Examiner* — Terrell McKinnon
*Assistant Examiner* — Michael McDuffie
(74) *Attorney, Agent, or Firm* — Myron Greenspan; Lackenbach Siegel LLP

(57) ABSTRACT

A picture frame hanging system includes a picture frame hanging bracket attachable to opposite, lateral or side picture frame portions. Each bracket includes a tortuous path for the picture hanging wire involving at least one end of the wire being bent about a radius that creates frictional forces between the wire and the bracket to sustain a tension representing the weight of the picture frame without disengaging from the brackets under load. The method involves attaching opposing brackets on the lateral sides of the picture frame and advancing the respective ends of the picture hanging wire through a tortuous path requiring the bending of the wire about a radius sufficiently small to ensure adequate frictional engagement between the wire and the brackets to ensure that the ends of the wire remain entrained within the brackets notwithstanding the tension forces that are applied to the wire when the frame is hung on a surface by means of the wire.

15 Claims, 5 Drawing Sheets

(56) References Cited

U.S. PATENT DOCUMENTS

| | | | | | |
|---|---|---|---|---|---|
| 4,233,764 | A * | 11/1980 | Small | A47G 1/1666 | 248/489 |
| D262,687 | S | 1/1982 | Collet | | |
| 4,364,538 | A | 12/1982 | Tomlinson | | |
| 4,932,146 | A * | 6/1990 | Long | A47G 1/1666 | 40/759 |
| 5,100,094 | A * | 3/1992 | Handwerger | A47G 1/1666 | 248/489 |
| 6,094,783 | A * | 8/2000 | Parsons | B60P 7/0823 | 114/218 |
| 6,508,450 | B2 * | 1/2003 | Hayde | A47G 1/16 | 248/489 |
| 6,651,948 | B2 * | 11/2003 | Szarata | A47G 1/1666 | 248/489 |
| 6,672,237 | B2 * | 1/2004 | Hillier | B63B 21/08 | 114/218 |
| 6,966,534 | B2 | 11/2005 | Kamenstein et al. | | |
| 7,237,307 | B2 * | 7/2007 | Feschuk | F16G 11/00 | 24/115 R |
| 7,513,477 | B2 * | 4/2009 | Lampert | A47G 1/18 | 248/466 |
| 8,181,312 | B2 * | 5/2012 | Attinger | B66B 7/085 | 187/411 |
| 8,297,571 | B2 * | 10/2012 | Xue | F16M 11/041 | 248/220.22 |
| 8,935,832 | B2 * | 1/2015 | Chuang | A47H 3/02 | 160/178.2 |
| 2015/0327695 | A1 * | 11/2015 | Miller | A47G 1/1666 | 248/493 |

* cited by examiner

PICTURE HANGER SYSTEM

BACKGROUND OF THE INVENTION

1. Field of the Invention

The present invention generally relates to hanging devices and, more specifically, a picture frame hanging bracket and system.

2. Description of the Prior Art

Numerous devices have been proposed for hanging picture frames. For example, U.S. Pat. No. 6,966,534 discloses a wire system for hanging picture frames. This patent discloses a device that secures wire and picture frames and other items mounted on a vertical support. The item can be used with both a single wire as well as two wires on a single picture frame. The disclosed device includes a support or bracket on which there are mounted rotatable levers that are complicated and cumbersome to use.

A PCT or International Published Patent Application WO2006091176 discloses a picture frame hanging device. Connectors are mounted on laterally opposing sides of a picture frame. Two substantially parallel threaded bores are formed in a housing. A wire to be secured is extended through a passage, generally in a vertical direction, and set screws are inserted through the threaded boxes to fix the wire within the passage. This requires the use of a screw driver or other suitable tool. It also creates the possibility of such set screws being lost or stripped, rendering the device fully or partially inoperative.

An adjustable picture hanging device design is disclosed in U.S. Design Pat. D262687. The disclosed device requires a separate eyelet or eye screw secured to the back of the picture frame. A wire extends through the eyelet and into a generally cylindrical plug having a raised rim at one end and a tapered conical portion at the other end. The wire extends through a central channel through the eyelet and the wire is then folded upon itself. The plug is then forced through the opening in the eyelet to provide a press or friction fit, with the free end of the wire being captured between the plug and the eyelet. This device, therefore, includes two separate nesting parts either one of which can be lost or misplaced.

U.S. Pat. No. 1,455,961 is for a picture hanger and U.S. Pat. No. 4,364,538 for an adjustable cable picture-hanging system both involve the use of clamps and a plurality of separate parts or components.

SUMMARY OF THE INVENTION

Accordingly, it is an object of the invention to provide a picture hanger system that does not have the disadvantages of picture hanging devices that have been proposed in the prior art.

It is another object of the invention to provide a picture hanger system that is simple in construction and economical to manufacture.

It is still another object of the invention to provide a picture hanging system as suggested that is simple and convenient to use.

It is yet another object of the invention to provide a picture hanging system of the type suggested above that of a single part construction.

It is a further object of the invention to provide a picture hanging system in accordance with the above object that can secure a picture hanging wire without the use of set screws or special wire locking devices.

It is still a further object of the invention to provide a picture hanging system that can be quickly secured to a picture hanging wire without the use of special tools.

It is yet a further object of the invention to provide a picture hanging system of the type under discussion that can securely entrain a range of typical or conventional picture hanging wires of the type conventionally used to hang picture frames.

In order to achieve the above objects, as well as others that will become evident hereinafter, a picture hanging system includes picture frame hanging brackets each attachable to opposite, lateral or side picture frame portions. Each bracket includes a tortuous path for the picture hanging wire involving at least one bend of the wire about a radius that creates a frictional force between the wire and the bracket to at least sustain a tension representing the weight of the picture frame without disengaging from the brackets under load. The method involves attaching the opposing brackets on the lateral sides of the picture frame and advancing the respective ends of the picture hanging wire through a tortuous path in each bracket requiring the bending of the wire about a radius sufficiently small to ensure adequate frictional engagement between the wire and the brackets to ensure that the ends of the wire remain entrained within the brackets notwithstanding the tension forces that are applied to the wire when the frame is hung on a surface by means of the wire.

BRIEF DESCRIPTION OF THE DRAWINGS

Those skilled in the art will also appreciate the improvements and advantages that derive from the present invention upon reading the following detailed description in conjunction with the Figures in which.

DETAILED DESCRIPTION OF THE PREFERRED EMBODIMENT

Figure 1:
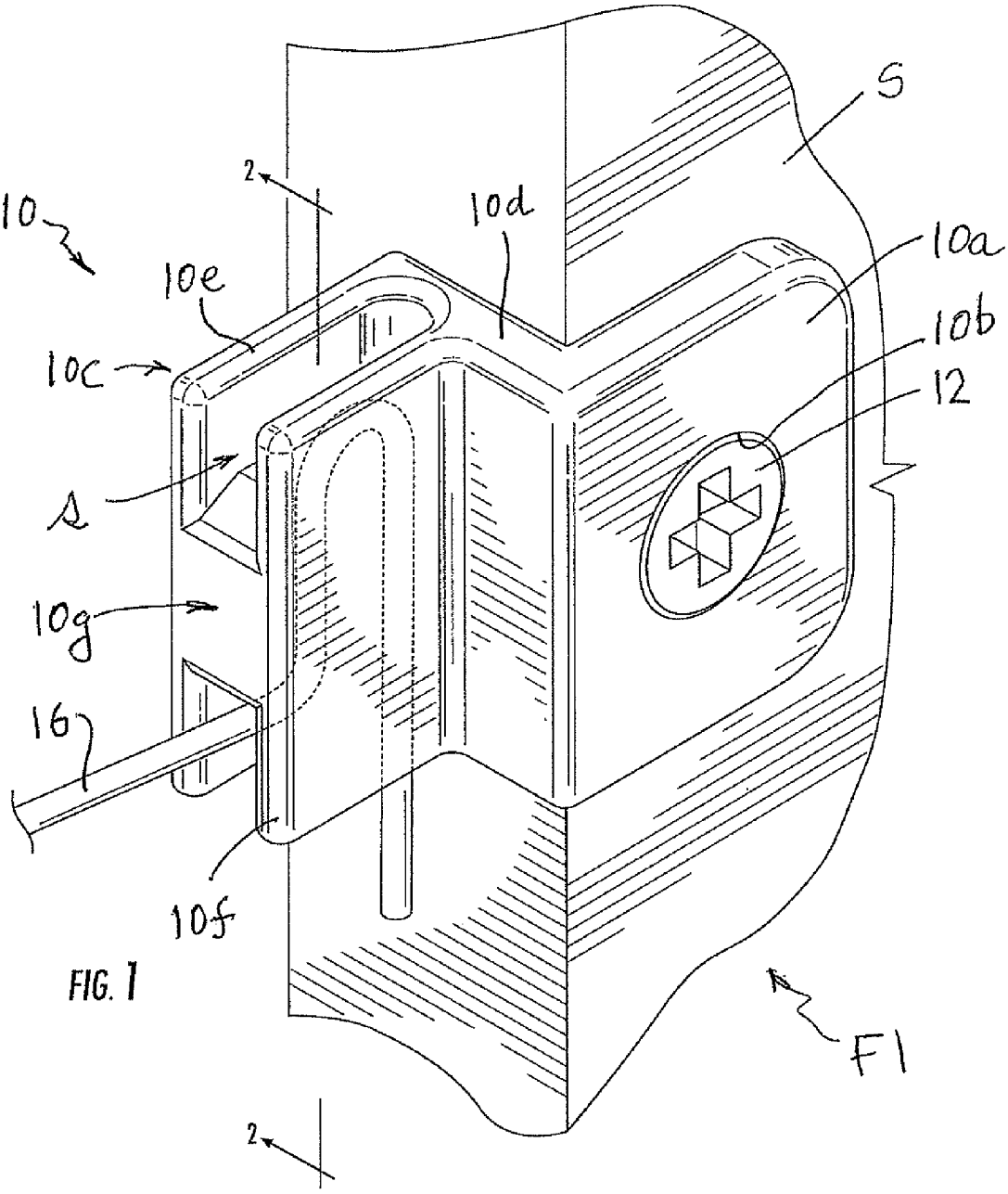
FIG. 1 is a perspective view of a picture frame hanging bracket in accordance with the present invention secured to one vertical lateral frame member with a picture hanging wire inserted into the bracket.

Referring now to the Figures, in which the identical or similar parts have been designated by the same reference numerals throughout, and first referring to FIG. 1, a picture frame hanging bracket in accordance with the present invention is generally designated by the reference numeral 10.

The bracket 10 includes a mounting tab 10*a* provided with a hole 10*b*. The tab 10*a* is flat and suitable for abutment against a rear surface S of a vertical or lateral frame member F1. A suitable fastener, such as a screw 12, secures the tab 10*a* to the surface S.

The picture frame hanging bracket 10 shown in FIG. 1 is generally of the category of offset or recessed picture frame hangers of the type described in co-pending U.S. patent application Ser. No. 14/250,646, which is incorporated as if fully set forth herein.

A wire entrainment or affixing portion 10*c* is offset from the plane of the mounting tab 10*a* by a transverse portion 10*d* to generally place or position the wire entrainment portion 10*c* within the depth of the vertical frame member F1. However the length of the transverse offsetting portion 10*d* is not critical and may be selected to position the wire entrainment portion 10*d* anywhere within the recess formed by the frame.

The wire entrainment portion 10*c* consists of two spaced walls 10*e*; 10*f* to create a space s dimensioned to receive a picture hanger wire 16 with at least some clearance.

Figure 2:
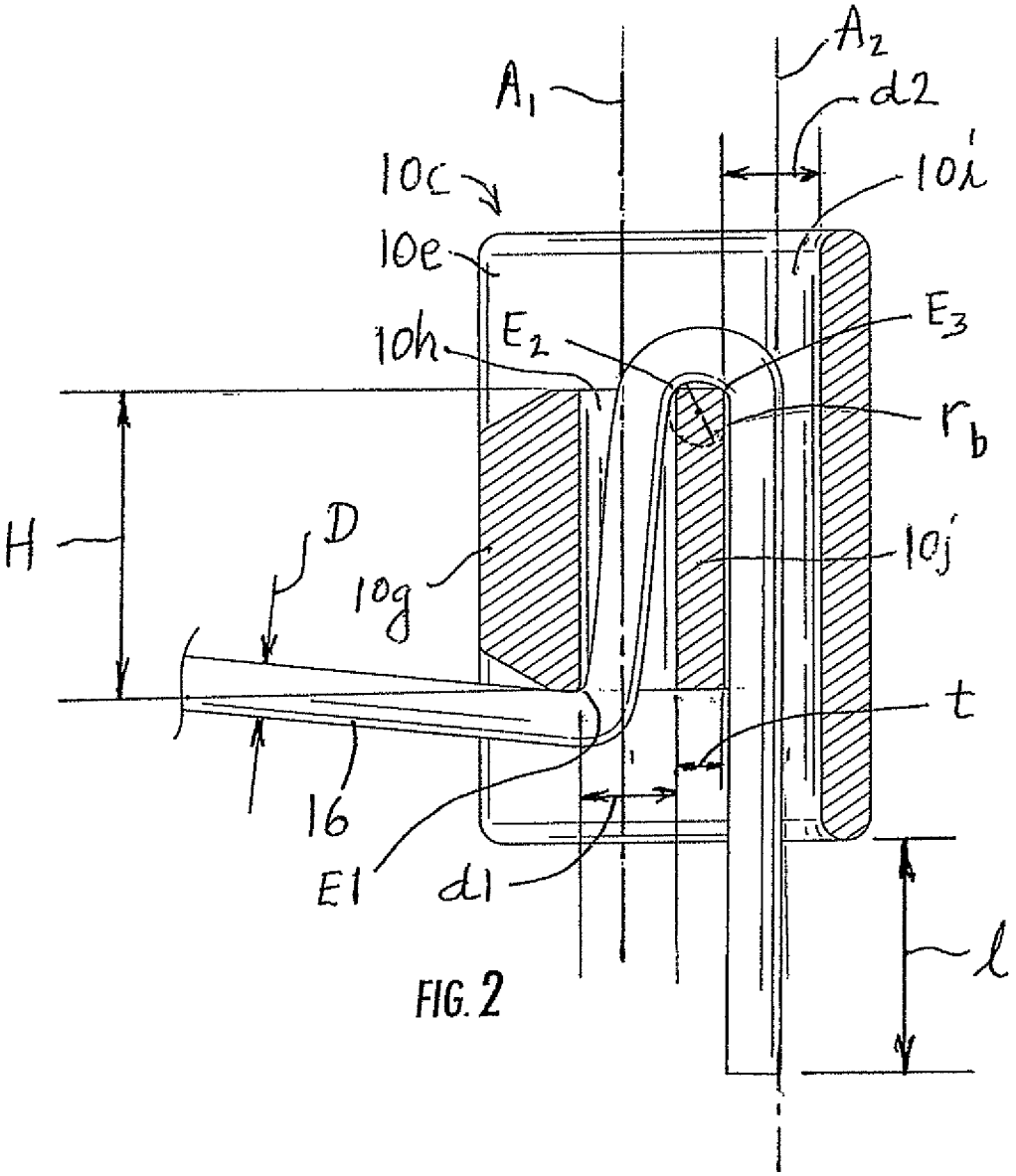
FIG. 2 is a cross actual view of the bracket shown in FIG. 1, taken along line 2-2.

Referring specifically to FIG. 2, a central core 10*g* having a height H is provided between the two walls 10*e*, 10*f*. Two vertical channels 10*h*, 10*i* are provided within the central core 10*g* spaced from each other generally along a horizontal direction and have diameters d1, d2 and axes A1, A2 respectively. The diameters d1, d2 need not be identical although in the presently preferred embodiment they are substantially equal to each other. The spaced channels 10*h*, 10*i* form an intermediate barrier or separation wall portion 10*j* as shown. A generally sharp edge E1 is formed at the bottom of the channel 10*h* and generally sharp edges E2, E3 are formed at the upper ends of the channels 10*h*, 10*i* as shown.

While the specific dimensions to be described are not critical a presently preferred embodiment illustrated has the channels 10*h*, 10*i* having a radius equal to approximately 0.4" the channels being horizontally spaced from each other to form a barrier wall or vertical wall portion 10*j* having a thickness of approximately 0.05" when the spaces between the axes A1, A2 of the channels are separated approximately 0.15". The height of the core 10*g* and, therefore, the axial length of the channels 10*h*, 10*i* is approximately 0.3".

Flexible picture hanging wires are generally available in standard braided type or stranded stainless steel. Such wires come in various sizes rated up to 100 lbs. Braided picture wire is made from braided or interwoven strands of thin galvanized steel wire making the finished product strong, in terms of its breaking strength, yet flexible. Stainless steel wire generally consists of seven individual strands of stainless steel wire that are twisted under tension, like a cable, rather than being braided. Such wires make stainless steel comparatively stronger than braided wire, but at the expense of some flexibility in the larger sizes. Typically, diameters of braided picture wire range from 0.40"-0.90" (#2-#8 wire sizes) having maximum recommended loads or weights of 12 lbs-36 lbs, representing a safety margin of about 4.25 from the breaking strengths of the wires. Stainless steel picture wires typically range in diameter from 0.28"-0.60" (#3-#9 wire sizes) having maximum recommended loads or weights of 25 lbs-100 lbs with the same safety margins. Picture wire that is finger-friendly is coated with a protective plastic coating or sleeve. The diameters d1, d2 of the vertical channels 10*h*, 10*i* are selected, therefore, to receive and accommodate any of these commonly used picture wires, whether braided or stainless steel, with or without a coating.

Figure 3A:
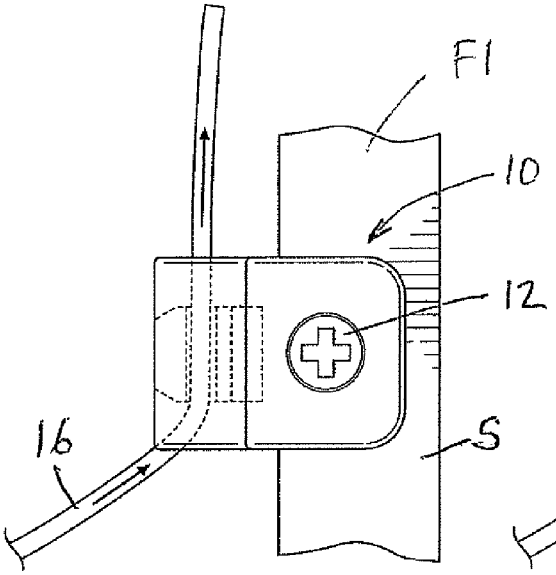
FIGS. 3A-3C are side views of the bracket shown in FIG. 1 and illustrating successive steps for advancing or guiding the end of a picture hanging wire or cable through the bracket to entrain or fix the end of the wire within the bracket.
Figure 3B:
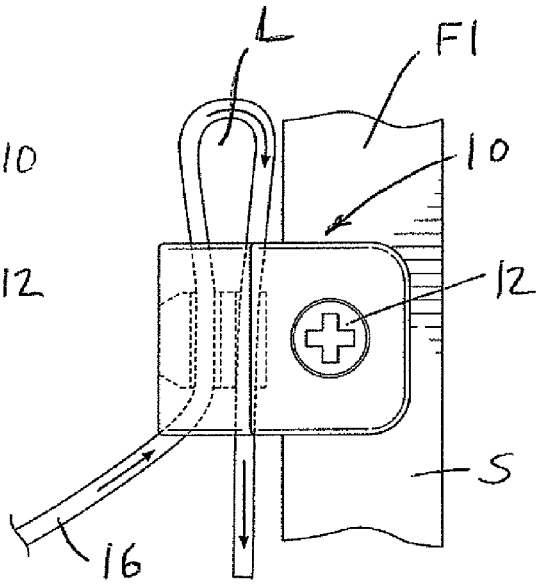
Figure 3C:
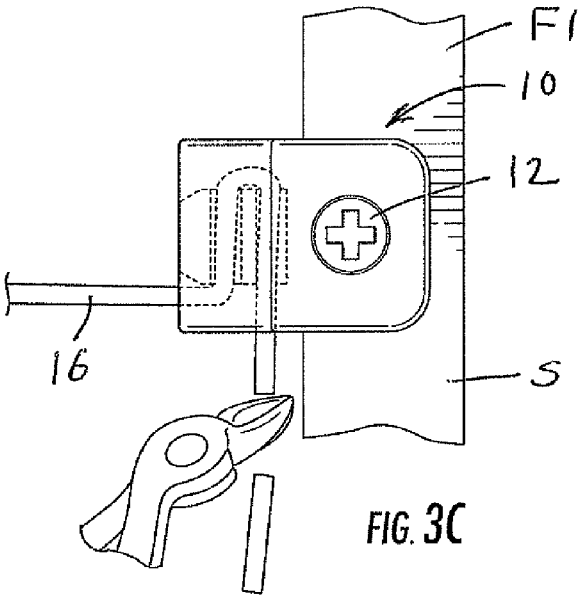

As suggested in FIG. 1 and more specifically illustrated in FIGS. 3A-3C, the method of securing a free end of a pictured wire 16 to a hanging bracket 10 involves first guiding one end of the wire 16 upwardly through the first channel 10*h* as shown in FIG. 3A and then reversing the direction of the free end and guiding it downwardly through the second channel 10*i* as shown in FIG. 3B to form a loop L. The free end is then drawn downwardly and pulled tight while the portion of the wire within the channel 10*h* is secured to reduce the size of the loop at the upper end of the bracket until the loop L is reduced to the point that the wire comes into contact with the upper end of the wall portion or barrier 10*j* as shown in FIGS. 1 and 3C. The trailing end of the wire can then be bent upwardly as shown in FIG. 3C from essentially a vertical orientation shown in FIG. 3A to a generally horizontal orientation shown in FIG. 3C. The leading end extending below the bracket 10 may be cut to a length 1 if desired as shown in FIG. 2. The effect of such manipulations of the wire produces a number of desired results. Initially, raising the trailing end of the wire to a substantially horizontal orientation brings the wire in contact with edge E1 at the lower end of the channel 10*h*. Additionally, the wire is caused to bend about the upper portion of the barrier or wall portion 10*j* as shown. When the thickness of the barrier or wall portion 10J is approximately 0.05", the wire is effectively bent twice about a radius rb of approximately 0.25" with the wire or cable 16 having a diameter of 0.07" that results in a ratio of the bending radius rb to wire radius (D/2) of approximately 0.71". Depending on the specific nature of the steel used and the number of strands, such bending ratios have been determined to securely entrain the wire within the bracket to prevent slippage when the recommended load is placed on the wire. Normally the minimum bending radius of a material indicates how tightly a cable can be bent before there is permanent deformation of the wire, while bending of the cable beyond its yield strength to provide elastic deformation could improve the holding power of the bracket on the wire or cable such permanent elastic deformation is not always required with the subject bracket. Considering the safety margins recommended for the use of such wires in relation to the loads that the wires are intended to support the frictional forces between the wire and the bracket at the edges E1-E3 are generally sufficient to retain the wire in place with or without elastic deformation.

Unduly increasing the dimension t of the barrier or portion 10*j*, thereby excessively increasing the bending radius, can reduce the holding power. However, decreasing the bending radius by decreasing the dimension t excessively can result in exceeding the ultimate strength of the wire or cable and potentially damage it, especially if the barrier or wall portion 10*j* becomes sufficiently thin to pierce the insulation and damage the strands. Therefore, while the dimensions of the bracket are not critical the ratio of the bending radius at the upper end of the channels 10*h*, 10*i* to the radius of the wire may be between 0.25-10 with different degrees of advantage. The dimensions, clearly, can be scaled upwardly or downwardly to accommodate specific size ranges and constructions of wires or cables.

Figure 4:
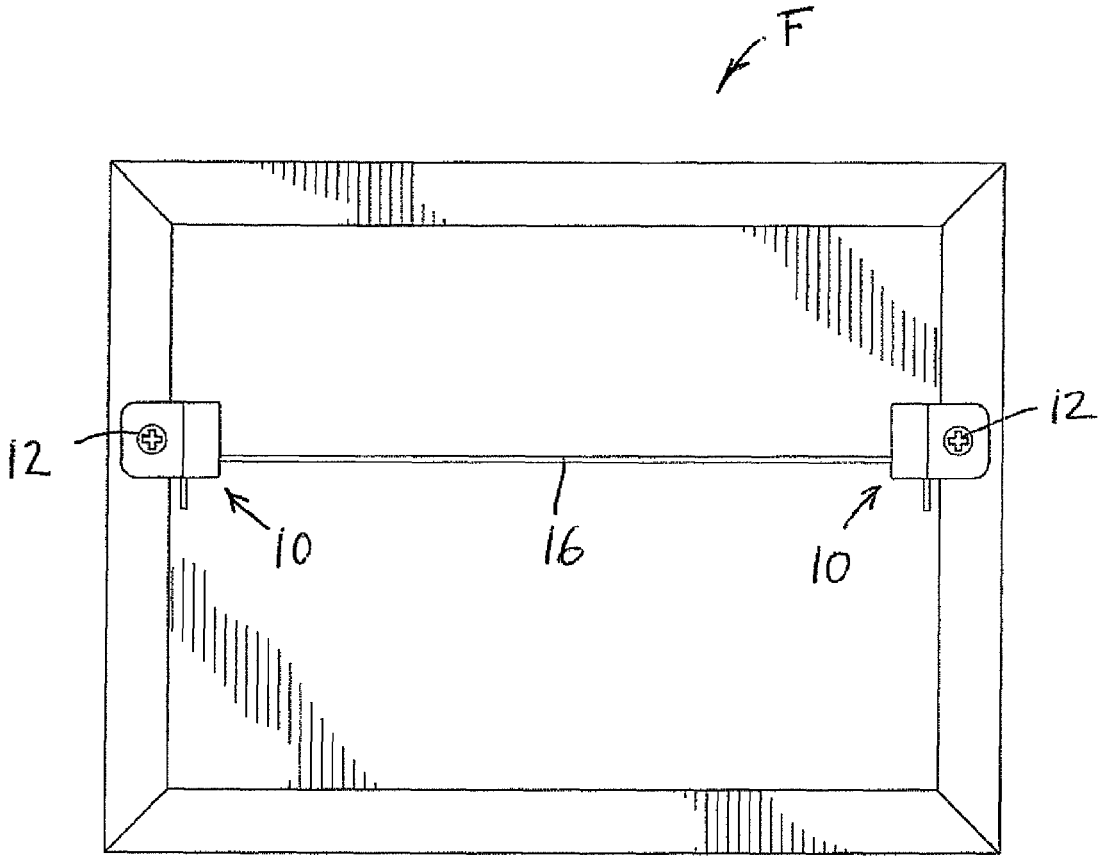
FIG. 4 is a rear elevational view of a picture frame illustrating two brackets in accordance with the invention securing a picture frame hanging wire extending between the brackets.

Referring to FIG. 4, the rear of a picture frame is shown with picture frame hanging brackets 10 mounted on the spaced vertical frame numbers F1, F2. The ends of the wire 16 are shown looped and guided through the hanging brackets 10 as described to tighten the wire between the brackets for mounting on a suitable fastener, such as a nail, hook or like on a wall or other surface.

Figure 5:
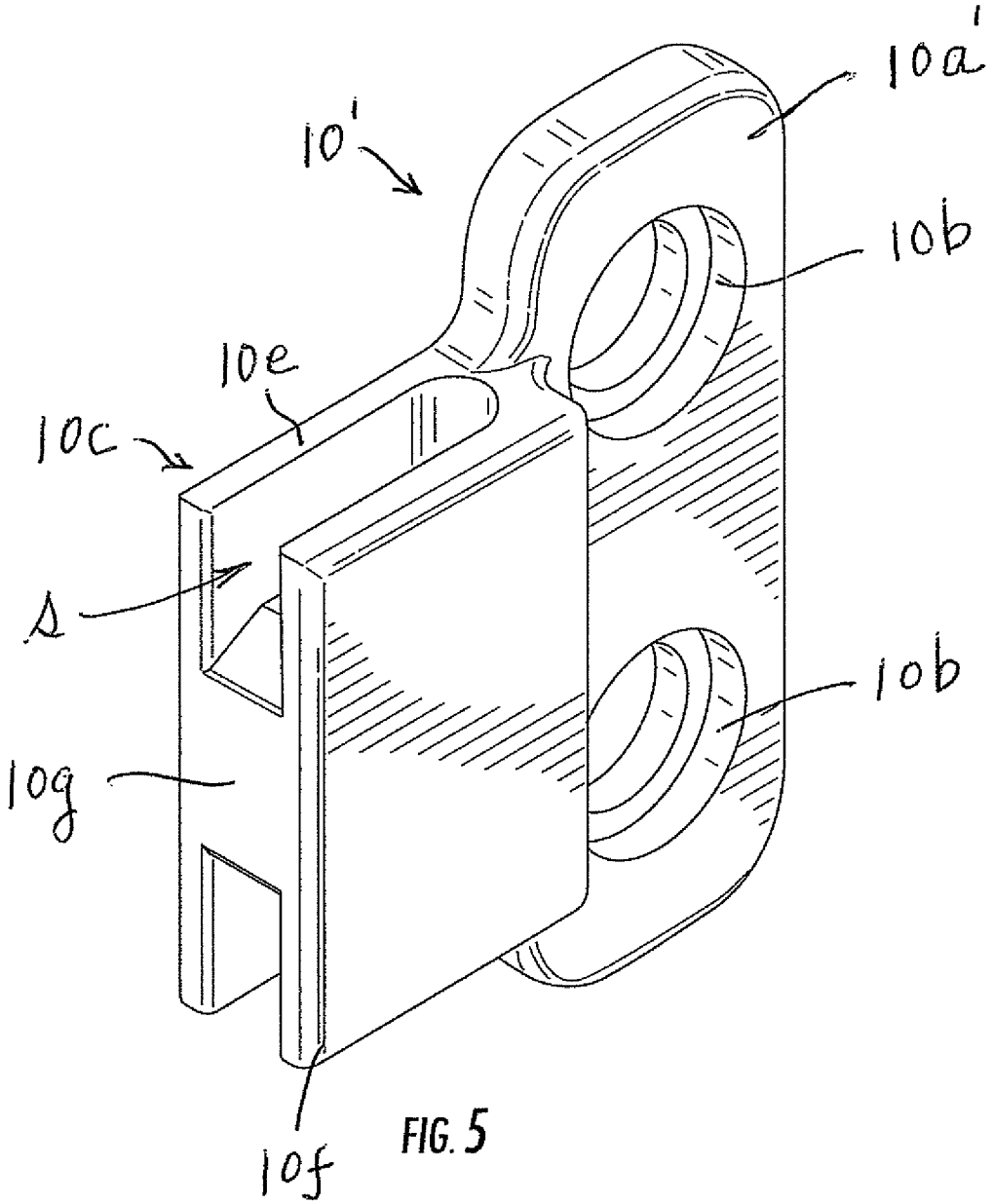
FIG. 5 is a perspective view of another embodiment of the picture frame hanging bracket embodying the features of the brackets shown in FIGS. 1-4 but designed to be mounted on a flat surface or portion of a picture frame.

Referring to FIG. 5, the identical wire entrainment portion 10*c* is used in conjunction with mounting tab 10*a*' that is in line with the wall 10*e* to make these coplanar to provide a single mounting surface that can interface with a flat surface on a frame, when the frame does not have a central recess, cavity or opening as shown FIG. 1. Otherwise, the picture frame hanging bracket 10' is similar to the one describe and operates and functions in the same way.

It will be immediately evident that the picture frame hanging brackets in accordance with the present invention are simple in construction and convenient to use. Once the brackets are mounted on a frame no further tools are required and there is no need to use separate locking devices, such as set screws, clamps or the like to ensure that the free ends of the wire are secured and will not slip out of the bracket. In both cases, the wire can be separated from the brackets by reversing the steps shown in FIGS. 3A-3C by upwardly urging the free end of the wire through the channel **10*i* to increase the size of the upper loop L, removing the free end from that channel and subsequently pulling the wire downwardly through the channel 10*h***. This process is reversible in either direction.

The invention claimed is:

1. A hanger for attaching a picture frame having spaced horizontal upper and lower rails and spaced lateral rails having a predetermined depth, and said rails having front surfaces visible when the frame is mounted on a wall and rear surfaces facing a wall on which the frame is to be mounted, said hanger comprising a first connecting portion projecting in a predetermined direction and having a predetermined thickness and arranged in a first plane and a second connecting portion comprising two spaced walls projecting in a direction opposite to said predetermined direction, said second connecting portion being offset from said first connecting portion and arranged in a second plane substantially parallel to said first plane and rigidly connected to said first connecting portion by a bridging portion, said first and second planes being spaced a distance less than said predetermined depth of said rails between said front and rear surfaces, said first connecting portion including first means for attaching the hanger to a rail rear surface, said second connecting portion including retaining means for retaining one end of an elongate cord or cable and being offset by said bridging portion to position said second connecting portion internally of a space formed by the rails of the frame between said front and rear surfaces and offset or spaced from a wall or supporting surface in a normal hanging position of the frame, said second connecting portion including second means for cooperating with a fastener on a wall or supporting surface, whereby the frame can be supported on a wall or supporting surface while being spaced from the wall or supporting surface substantially by said predetermined thickness of said first connecting portion.

2. A hanger as defined in claim 1, wherein said bridging portion is dimensioned to position said second connecting portion substantially midway within said predetermined depth.

3. A hanger as defined in claim 1, wherein said first and second connection portions and said bridging portion are integrally formed.

4. A hanger for attaching a picture frame having spaced horizontal upper and lower rails and spaced lateral rails having a predetermined depth, and said rails having front surfaces visible when the frame is mounted on a wall and rear surfaces facing a wall on which the frame is to be mounted, said hanger comprising a first connecting portion projecting in a predetermined direction and having a predetermined thickness and arranged in a first plane and a second connecting portion comprising two spaced walls projecting in a direction opposite to said predetermined direction, said second connecting portion being offset from said first connecting portion and arranged in a second plane substantially parallel to said first plane and rigidly connected to said first connecting portion by a bridging portion, said first and second planes being spaced a distance less than said predetermined depth of said rails between said front and rear surfaces, said first connecting portion including first means for attaching the hanger to a rail rear surface, said second connecting portion including retaining means for retaining one end of an elongate cord or cable and being offset by said bridging portion to position said second connecting portion internally of a space formed by the rails of the frame between said front and rear surfaces and offset or spaced from a wall or supporting surface in a normal hanging position of the frame, said second connecting portion including second means for cooperating with a fastener on a wall or supporting surface with said second connecting portion arranged between said first and second planes with the exception of said first connecting portion which is secured to a rear surface of one of said rails.

5. A hanger as defined in claim 4, wherein said bridging portion is dimensioned to position said second connecting portion substantially midway within said predetermined depth.

6. A hanger as defined in claim 4, wherein a pair of hangers are provided with each of the hangers being attachable to another one of the spaced lateral rails, and further comprising an elongate cord or cable extending between and secured to said second connecting portions of said hangers and suitable for being supported on a fastener mounted on a wall or supporting surface.

7. A hanger as defined in claim 4, wherein said first and second connection portions and said bridging portion are integrally formed.

8. A hanger as defined in claim 4, wherein said retaining means comprises two spaced channels separated by an intermediate barrier or separation wall portion for receiving the end of the elongate cord or cable bent about said wall portion where said channels meet.

9. A hanger for attaching a picture frame having spaced horizontal upper and lower rails and spaced lateral rails having a predetermined depth in combination with a fastener securable to a wall or supporting surface, and said rails having front surfaces visible when the frame is mounted on the wall and rear surfaces facing a wall on which the frame is to be mounted, said hanger comprising a first connecting portion projecting in a predetermined direction and having a predetermined thickness and arranged in a first plane and a second connecting portion comprising two spaced walls projecting in a direction opposite to said predetermined direction, said second connecting portion being offset from said first connecting portion and arranged in a second plane substantially parallel to said first plane and rigidly connected to said first connecting portion by a bridging portion, said first and second planes being spaced a distance less than said predetermined depth of said rails between said front and rear surfaces, said first connecting portion including first means for attaching the hanger to a rail rear surface, said second connecting portion including means for retaining one end of an elongate cord or cable and being offset by said bridging portion to position said second connecting portion internally of said space formed by the rails of the frame between said front and rear surfaces and offset or spaced from a wall or supporting surface in a normal hanging position of the frame, said second connecting portion including second means for cooperating with said fastener on a wall or supporting surface, said fastener being dimensioned to be receivable within said space formed by said rails whereby the frame can be supported on a wall or supporting surface while being spaced from the wall or supporting surface substantially by said predetermined thickness of said first connecting portion.

10. A hanger as defined in claim 9, wherein said bridging portion is dimensioned to position said second connecting portion substantially midway within said predetermined depth.

11. A hanger as defined in claim 9, wherein a pair of hangers are provided with each of the hangers being attachable to another one of the spaced lateral rails, and further comprising an elongate cord or cable extending between and secured to said second connecting portions of said hangers and suitable for being supported on a fastener mounted on a wall or supporting surface.

12. A hanger as defined in claim 9, wherein said first and second connection portions and said bridging portion are integrally formed.

13. A hanger as defined in claim 9, wherein said first and second connecting portions and said bridging portion having a substantially uniform cross-section along a direction substantially parallel to said first and second planes.

14. A hanger as defined in claim 9, wherein said retaining means comprises two spaced channels separated by an intermediate barrier or separation wall portion for receiving the end of the elongate cord or cable bent about said wall portion where said channels meet.

15. A hanger for attaching a picture frame having spaced horizontal upper and lower rails and spaced lateral rails having a predetermined depth, and said rails having front surfaces visible when the frame is mounted on a wall and rear surfaces facing a wall on which the frame is to be mounted, said hanger comprising a first connecting portion projecting in a predetermined direction and having a predetermined thickness and arranged in a first plane and a second connecting portion comprising two spaced walls projecting in a direction opposite to said predetermined direction, said second connecting portion being offset from said first connecting portion and arranged in a second plane substantially parallel to said first plane and rigidly connected to said first connecting portion by a bridging portion, said first and second connection portions and said bridging portion together form a substantially "Z" or "S" shaped uniform cross-section along a direction substantially parallel to said first and second planes, said first and second planes being spaced a distance less than said predetermined depth of said rails between said front and rear surfaces, said first connecting portion including first means for attaching the hanger to a rail rear surface, said second connecting portion including retaining means for retaining one end of an elongate cord or cable and being offset by said bridging portion to position said second connecting portion internally of a space formed by the rails of the frame between said front and rear surfaces and offset or spaced from a wall or supporting surface in a normal hanging position of the frame, said second connecting portion including second means for cooperating with a fastener on a wall or supporting surface with said second connecting portion arranged between said first and second planes with the exception of said first connecting portion which is secured to a rear surface of one of said rails.

* * * * *